US007419458B2

(12) United States Patent
Forcillo

(10) Patent No.: US 7,419,458 B2
(45) Date of Patent: Sep. 2, 2008

(54) ADJUSTABLE STATIONARY EXERCISE BICYCLE

(75) Inventor: John Forcillo, Laval (CA)

(73) Assignee: STS World Concept Ltd., Quebec (CA)

( * ) Notice: Subject to any disclaimer, the term of this patent is extended or adjusted under 35 U.S.C. 154(b) by 430 days.

(21) Appl. No.: 10/609,320

(22) Filed: Jun. 30, 2003

(65) Prior Publication Data

US 2004/0053750 A1 Mar. 18, 2004

Related U.S. Application Data

(63) Continuation-in-part of application No. 10/008,414, filed on Nov. 13, 2001, now Pat. No. 6,612,970, which is a continuation-in-part of application No. 09/696,948, filed on Oct. 27, 2000, now Pat. No. 6,669,603, which is a continuation-in-part of application No. 09/263,858, filed on Mar. 8, 1999, now abandoned.

(60) Provisional application No. 60/101,573, filed on Sep. 24, 1998.

(51) Int. Cl.
*A63B 22/06* (2006.01)

(52) U.S. Cl. ..... 482/57; 482/63; 482/119

(58) Field of Classification Search ..... 482/51–53, 482/57–65, 117–120; D21/667
See application file for complete search history.

(56) References Cited

U.S. PATENT DOCUMENTS 3,622,153 A 11/1971 Thompson ..... 272/73
4,671,396 A 6/1987 Kotamaki
D291,462 S 8/1987 Aalto ..... D21/667
5,466,203 A * 11/1995 Chen ..... 482/63
5,643,153 A 7/1997 Nylen et al.
D382,925 S 8/1997 Wu ..... D21/667

(Continued)

FOREIGN PATENT DOCUMENTS

CA 876878 7/1971

(Continued)

OTHER PUBLICATIONS

"Body Bike Instructor Training School" Brochure. Exhibit 8.

(Continued)

*Primary Examiner*—Jerome Donnelly
*Assistant Examiner*—Tam Nguyen
(74) *Attorney, Agent, or Firm*—Davidson Berquist Jackson & Gowdey LLP

(57) ABSTRACT

A new and unique highly adjustable stationary exercise bicycle is presented incorporating a number of features specifically designed for youthful stationary bicycle users. The improvements over the prior art include infinitely adjustable vertical and horizontal seat heights and handlebar heights which are secured in their positions by a quick release lever rather than the standard pop pins. Also included is a lubrication port that allows the surface between the friction member and the working wheel to be lubricated. An emergency brake for the working wheel as well as a quick way to disengage the working wheel from the pedals is provided. Special pedal cage brackets are placed around each pedal so that the youth's use of such an exercise bicycle is made much more safely. All of the above elements combine to make this stationary exercise bicycle safe for use by children or adolescents.

24 Claims, 7 Drawing Sheets

U.S. PATENT DOCUMENTS

| | | | | | |
|---|---|---|---|---|---|
| 5,823,919 | A * | 10/1998 | Eschenbach | 482/62 |
| 5,961,424 | A * | 10/1999 | Warner et al. | 482/63 |
| 6,099,440 | A * | 8/2000 | Schurter et al. | 482/63 |
| 6,466,203 | B2 * | 10/2002 | Van Ee | 482/63 |
| 6,491,606 | B1 * | 12/2002 | Swift | 482/57 |
| 6,491,608 | B1 * | 12/2002 | Stearns | 482/96 |
| 6,612,970 | B2 * | 9/2003 | Forcillo | 482/57 |
| 6,669,603 | B1 * | 12/2003 | Forcillo | 482/57 |

FOREIGN PATENT DOCUMENTS

| | | |
|---|---|---|
| DE | 2252491 | 5/1974 |
| DE | 29717853 U1 | 1/1998 |

OTHER PUBLICATIONS

"Body Bike Future Workout" Brochure, Exhibit 5.

"Brunswick Corporation's Responses to Plaintiff's First Set of Interrogatories to Defendants" Jul. 6, 2004, C04-00848L. Western District of Washington at Seattle. Exhibit 48.

"Declaration of Brian G. Bodine in Support of Defendant's Motions for Summary Judgment" With Exhibits A-O. Dec. 9, 2004. C04-848R. Western District of Washington at Seattle. Exhibit 31.

"Declaration of John A. Knox in Opposition to Defendants Motion for Partial Summary Judgment Based on Best Mode and Motion to Strike the Simenauer Report and Exclude His Testimony" Jan. 3, 2005. C04-848JLR. Western District of Washington at Seattle. Exhibit 28.

"Declaration of John A. Knox in Opposition to Defendants Motion for Partial Summary Judgment of Unenforcability" Dec. 27, 2004. C04-848JLR. Western District of Washington at Seattle. Exhibit 33.

"Defendant Lemond Fitness, Inc's Third Interrogatories to Plaintiff (14-15) and Answers Thereto". Oct. 24, 2004. C04-848JLR. Western District of Washington at Seattle. Exhibit 46.

"Defendants'First Amended Counterclaims" May 6, 2004. C04-848L. Western District of Washington at Seattle. Exhibit 17.

"Defendant's Initial Invalidity Contentions" from Case No. 2:04-cv-848JLR, Western District of Washington at Seattle. Exhibit 11.

"Defendant's Initial Invalidity Contentions." Aug. 11, 2004. C04-0848R. Western District of Washington at Seattle. Exhibit 25.

"Defendants Lemond Fitness, Inc. and Brunswick Corporation, Inc.'s Answer to Complaint for Patent Infringement and Counterclaims" Case No. 03-565-MJR. Southern District of Illinois, Oct. 13, 2003. Exhibit 16.

"Defendants' Motion for Partial Summary Judgment of Unenforceability of U.S. Patent Nos. 6612970 and 6669603" Dec. 9, 2004. C04-848JLR. Western District of Washington at Seattle. Exhibit 30.

"Defendants' Motion for Summary Judgment Based on Best Mode." Dec. 9, 2004. C04-848R. Western District of Washington at Seattle. Exhibit 26.

"Defendants' Motion to Amend Counterclaims." Jun. 8, 2004. C04-848L. Western District of Washington at Seattle. Exhibit 18.

"Defendants' Second Amended Counterclaims." Jun. 11, 2004, C04-848:. Western District of Washington at Seattle. Exhibit 20.

"Defendants' Supplemental Invalidity Contentions" Dec. 9, 2004. C04-0848R. Western District of Washington at Seattle. Exhibit 37.

"Lemond Fitness Inc.'s Responses to Plantiff's First Set of Interrogatories to Defendants" Jul. 6, 2004. C04-0848L. Western District of Washington at Seattle. Exhibit 47.

"Meet the Future Workout" Brochure. Exhibit 7.

"Plaintiff John Forcillo's Complaint for Patent Infringment Against Lemond Fitness, Inc. and Brunswick Corporation, Inc." US District Court for the Southern District of Illinois. Sep. 3, 2003. Exhibit 15.

"Plaintiff's Answers to Defendants' First Set of Interrogatories (Nos. 1-10)". C04-00848L. Western District of Washington at Seattle. Exhibit 42.

"Plaintiff's Answers to Defendants Second Set of of Interrogatories (Nos. 11-13)". C04-00848L. Western District of Washington at Seattle. Exhibit 43.

"Plaintiff's Motion for Partial Dismissal of Defendants'Counterclaims." Jul. 23, 2004. C04-00848L. Western District of Washington at Seattle. Exhibit 21.

"Plaintiff's Preliminary Infringement Contentions." Jul. 7, 2004. C04-00848:. Western District of Washington at Seattle. Exhibit 24.

"Plaintiff's Response to Defendants Motion for Partial Summary Judgment Based on Best Mode." Jan. 3, 2005. C04-848JLR Western District of Washington at Seattle. Exhibit 27.

"Plaintiff's Response to Defendants'Motion for Partial Summary Judgement of Unenforceability of US Patent Nos. 6612970 and 6669603" Dec. 27, 2004. C04-848JLR. Western District of Washington at Seattle. Exhibit 32.

"Plaintiff's Response to Defendants'Motion to Amend Counterclaims," Jun. 8, 2004. C04-00848L Western District of Washington at Seattle. Exhibit 19.

"Plaintiff's Third [sic. Second]Set of Interrogatories (Nos. 11-21) [sic, Nos. 12-22]to Defendants and Response of Lemond Fitness, Inc. Thereto" Jan. 14, 2005. C04-848JLR. Western District of Washington at Seattle. Exhibit 44.

"Replay Brief in Support of Plaintiff's Motion for Partial Dismissal of Defendants'Counterclaims." Jul. 22, 2004. Western District of Washington at Seattle. Exhibit 23.

"Reply in Support of Defendants'Motion for Partial Summary Judgment of Unenforacability of US Patent Nos. 6612970 and 6669603" Nov. 16, 2004. C04-848JLR. Western District of Washington at Seattle. exhibit 34.

"Reply in Support of Defendants'Motion for Summary Judgment Based on Best Mode" Jan. 6, 2004. C04-848JLR. Western District of Washington at Seattle. Exhibit 29.

"Response to Plaintiff's Motion for Partial Dismissal of Defendants Counterclaims." Jul. 19, 2004. C04-848L. Western District of Washington at Seattle. Exhibit 22.

"The Body Bike1997" Brochure. Exhibit 4.

"The Continuing Development of the Fitness Bike-From in 1989 till the Latest Model 2000" Brochure. Exhibit 9.

Advertisement from Feb. 15, 1997 issue of Fitness Management. Exhibit 3.

Cover of Sep. 1997 Issue of "Idea Today". Exhibit 6.

Declaration of John Forcillo, Case No. 2:04-cv-848JLR, Western District of Washington at Seattle. Exhibit 1.

Deposition of John Forcillo Volumes I and II. Nov. 30-Dec. 1, 2004. C04-848JLR. Western District of Washington at Seattle. Exhibit 40.

Form PTO-1449 for New Reissue Application for Johnny Forcillo with Documents Cited. Exhibit 35.

Notice of References Cited for Application No. 10/609,320: Forcillo Reexamination Patent. Exhibit 36.

Offical Docket Listing from Civil Action 2:04-cv-00848-JLR, Western District of Washington at Seattle. Exhibit 14.

Photographs Bearing No. A001055, A001056, A001070-1073. Exhibit 12.

Photographs of Inner Parts of Original Body Bike numbered A001734-1740 and A001754-1762. Exhibit 2.

Sep. 2004 Document from www.Fitness-bike.com. Exhibit 10.

* cited by examiner

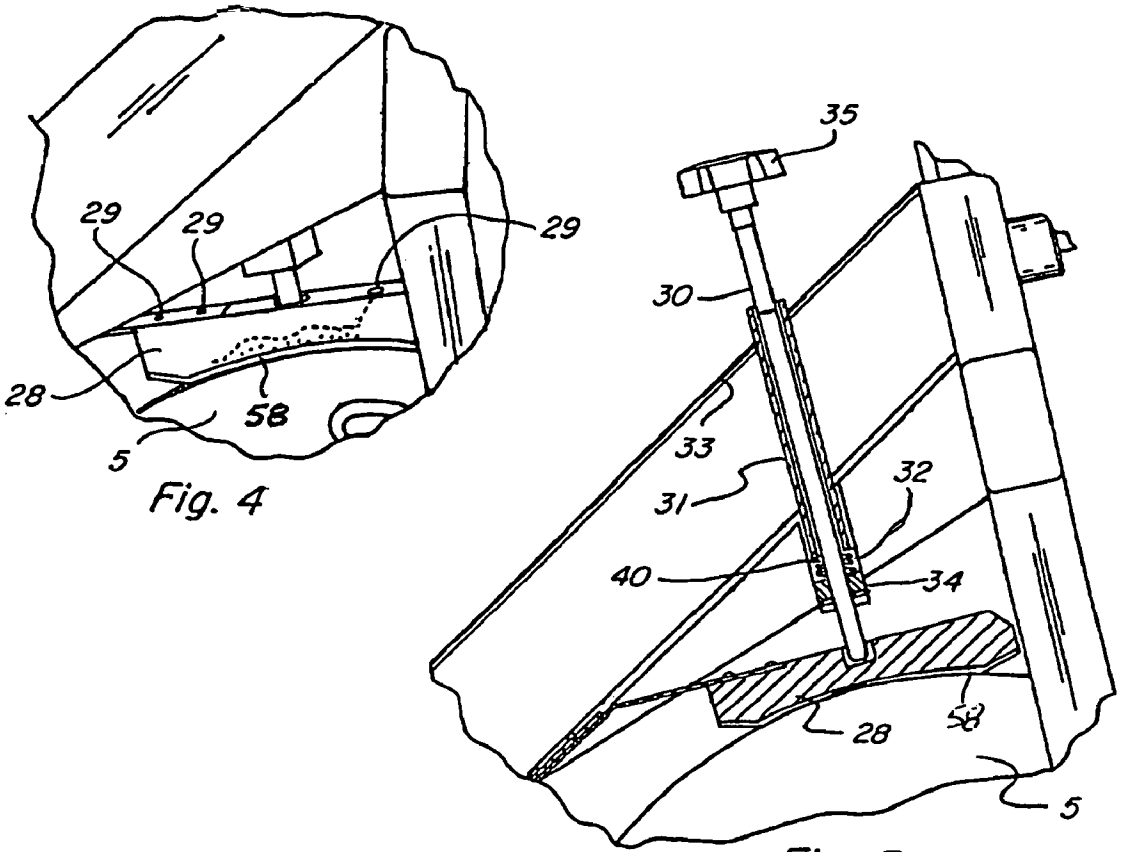
Fig. 5
Fig. 4
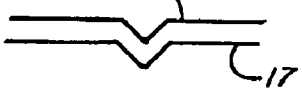
Fig. 3B
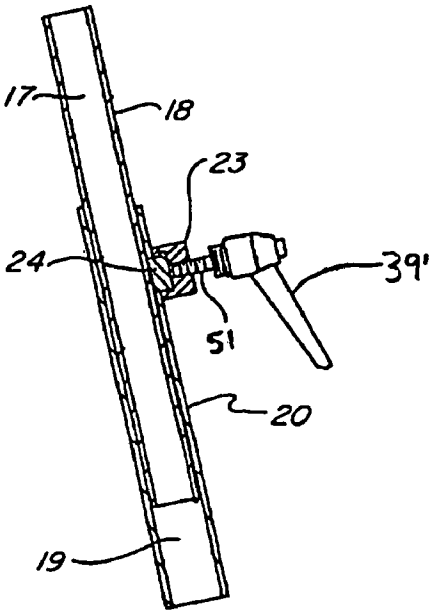
Fig. 3A

ADJUSTABLE STATIONARY EXERCISE BICYCLE

This is a continuation-in-part of Provisional application No. 60/101,573, filed Sep. 24, 1998 which was converted to Non-provisional applications, and of application Ser. No. 09/263,858, filed Mar. 8, 1999 now abandoned, and of application Ser. No. 09/696,948, filed Oct. 27, 2000 now U.S. Pat. No. 6,669,603 B1, and of application Ser. No. 10/008,414, filed Nov. 13, 2001 now U.S. Pat. No. 6,612,970 B2.

BACKGROUND OF THE INVENTION

This invention relates to the field of exercise equipment. More particularly, an exercise bicycle having numerous adjustments for size and workload is presented.

In the field of exercise equipment, stationary bicycles have become both useful and popular in the last few decades. The stationary bicycles currently in existence basically take the standard bicycle used on the roads and add either platforms or other framework such that the bicycle does not move. Various types of these stationary bicycles have been designed, including bicycles that entirely eliminate the back wheel. The bicycles usually have a seat and handlebars to simulate a regular bicycle but the pedals are connected to a front wheel that does not touch the floor.

Since obesity in North America is growing at a tremendous rate, innovations in the field of exercise equipment, particularly exercise bicycles, is quite desirable. With the advent of computers and television, children are becoming somewhat lazy and undisciplined. Children, in particular, need specialized equipment in order to keep up their exercise regiment.

Although many stationary exercise bicycles have been designed for adults, none have, as yet, been designed especially for children. A child's physical stature, as well as his somewhat inattentiveness to detail, necessitate a few important changes in the basic design of a stationary exercise bicycle. It is an object of this invention to provide an exercise bicycle designed especially for children or young adults.

One of the main advantages of a junior exercise bicycle is that the youngster can ride in the comfort of his home, thus exercising while still being entertained by their favorite music or television show. Further, while youth facilities are in big demand today, these gym facilities oftentimes only have equipment for adults. By creating an exercise bicycle developed especially for children, youngsters can make use of the gym facilities along with their adult parents or guardian, giving all participants a quality time together while increasing the fitness of adult and child alike. Studies with local universities and youth centers have proven that by working out in a group, the youth discipline and attentiveness is increased.

One of the problems encountered in the adult stationary exercise bicycle is that the smaller physique of children often prohibits them from using the exercise bicycle. For example, the positioning of the seat is very important for the comfort of the user. It is an object of this invention to provide a seat which may be specially adjusted to position a child to fit perfectly onto the stationary bicycle while still keeping in mind his growth patterns.

In addition to the height adjustment of the seat, it is also important to be able to adjust the height of the handlebars on the stationary bicycles. These adjustments have previously been made by the use of pop pins. However, pop pins are often not safe, particularly when used by inattentive youngsters. Further, pop pins also are not precise with respect to the spinal and leg adjustments. Pop pins utilize a series of incremental holes so that the adjustments must be made in incremental steps specified by the manufacturer. It is a further object of this invention to provide vertical and horizontal adjustments for the seat and height adjustments for the handle posts of a stationary bicycle such that they can be set at an infinite number of positions within the specified overall range. It is a still further object of this invention to provide for adjustments for the seat and handle posts of a stationary bicycle by means of a quickly releasable handle rather than a pop pin.

In the manufacture of exercise bicycles, it has been found that the tension placed on the exercise wheel could create a slight but irritating squeaking noise. Further, for children in particular, it is highly desirable to have the exercise wheel made such that the operator can coast, with the pedals remaining stationary even though the wheel is still moving forward. Further, for children's exercise bicycles in particular, it is also highly desirable that an emergency brake system or total release system be in place. The addition of these features greatly enhances the performance and safety of an exercise bicycle. These objects and other enhancements of this invention will become apparent upon reading the below-described Specification.

BRIEF DESCRIPTION OF THE DEVICE

A stationary exercise bicycle is presented having an adjustable seat and handlebars attached to a bottom frame. The frame also supports standard pedals and stems that are attached to a front exercise wheel. The vertical height and horizontal position of the seat is infinitely adjustable within a broad range by means of a quick attach handle. The vertical height and horizontal position f the handlebars may be similarly adjusted by means of a quick attach handle. The tension on the front exercise wheel is adjustable and squeaking is kept to a minimum by the introduction of lubricating oil through a specially designed lubricating port. The tensioning handle also has an emergency stop brake as well as a means for momentarily disengaging all friction on the wheel to facilitate a dismount. The working exercise wheel also has a directional clutch bearing such that the action of a modern bicycle is simulated. When the child using the exercise bicycle quits pedaling, the directional clutch allows the working wheel to continue in the clockwise position while providing no directional force to the pedals, which may then remain stationary. A special foot pedal bracket also keeps the child's foot securely in contact with the pedal as desired.

BRIEF DESCRIPTION OF THE DRAWING FIGURES

FIG. 3A is a side cutaway view of the quick release system for the handlebars and handle bar supports.

FIG. 3B is a side cutaway view of the front surface of the handle bar support and the bicycle support.

FIG. 4 is a detailed view of the lubricating ports and lubricating mechanism.

FIG. 5 is a detailed cutaway view of the exercise wheel tensioning system and the brake and quick release mechanism.

DETAILED DESCRIPTION OF THE PREFERRED EMBODIMENT

Figure 1:
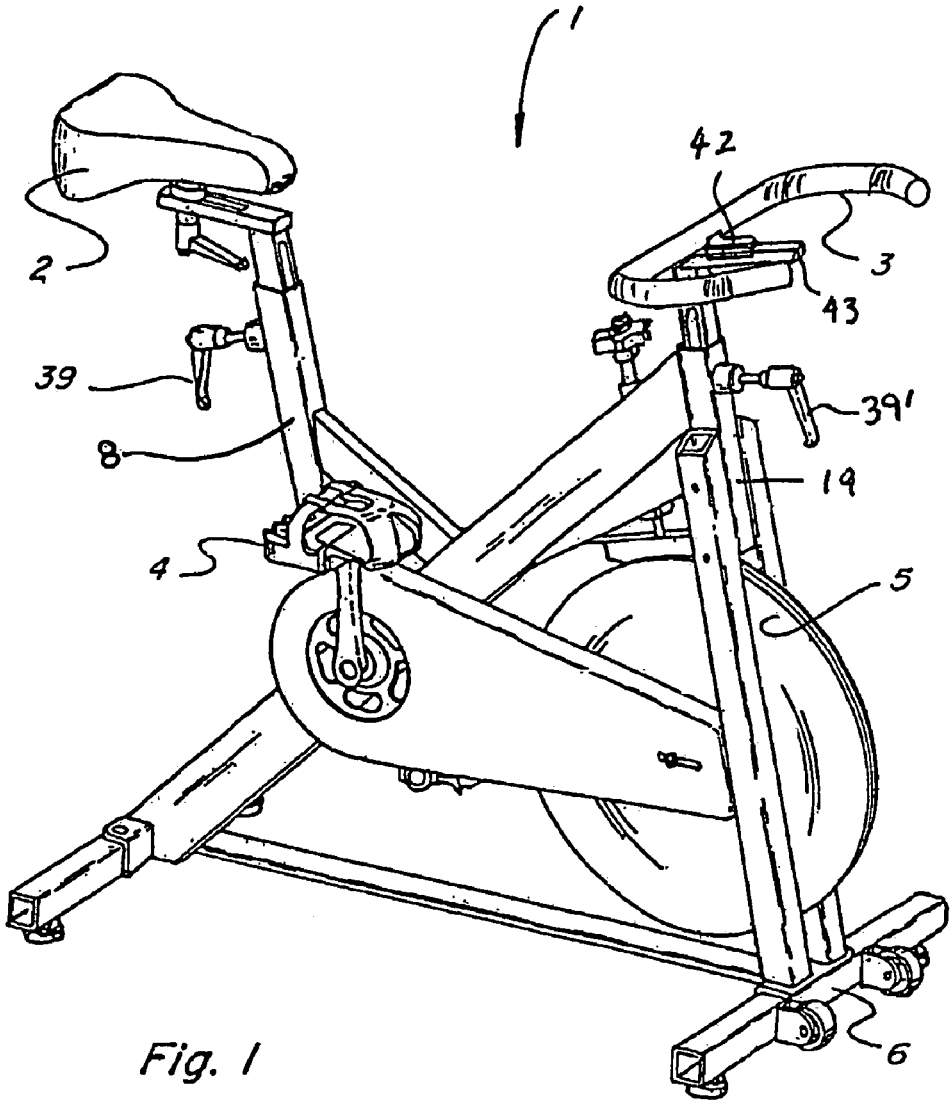
FIG. 1 is a perspective view of the child's stationary exercise bicycle.
Figure 1A:
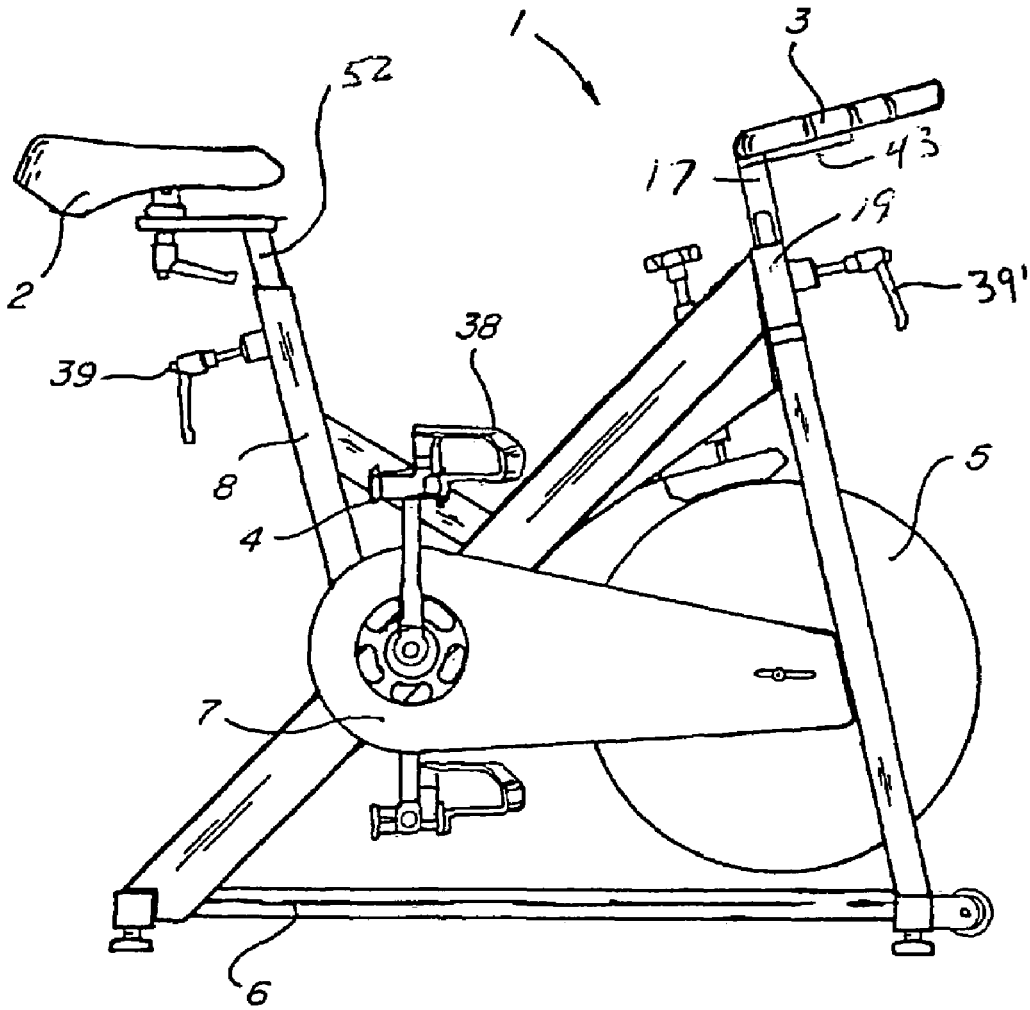
FIG. 1A is a side view of the child's stationary exercise bicycle.

A child's stationary exercise bicycle 1 is shown in FIGS. 1 and 1A. This is the general configuration of stationary exercise bicycles now common throughout North America, except that the instant device is smaller in size than an adult device. The basic elements of the stationary exercise bicycle include a seat 2, handlebars 3, pedals 4, and a working exercise wheel 5. These elements are all attached to a lower frame 6, as shown in FIGS. 1 and 1A. The pedals 4 are also attached to the working exercise wheel 5 by means of a chain or belt, which is enclosed in the drive guard 7.

Figures 2, 2A:
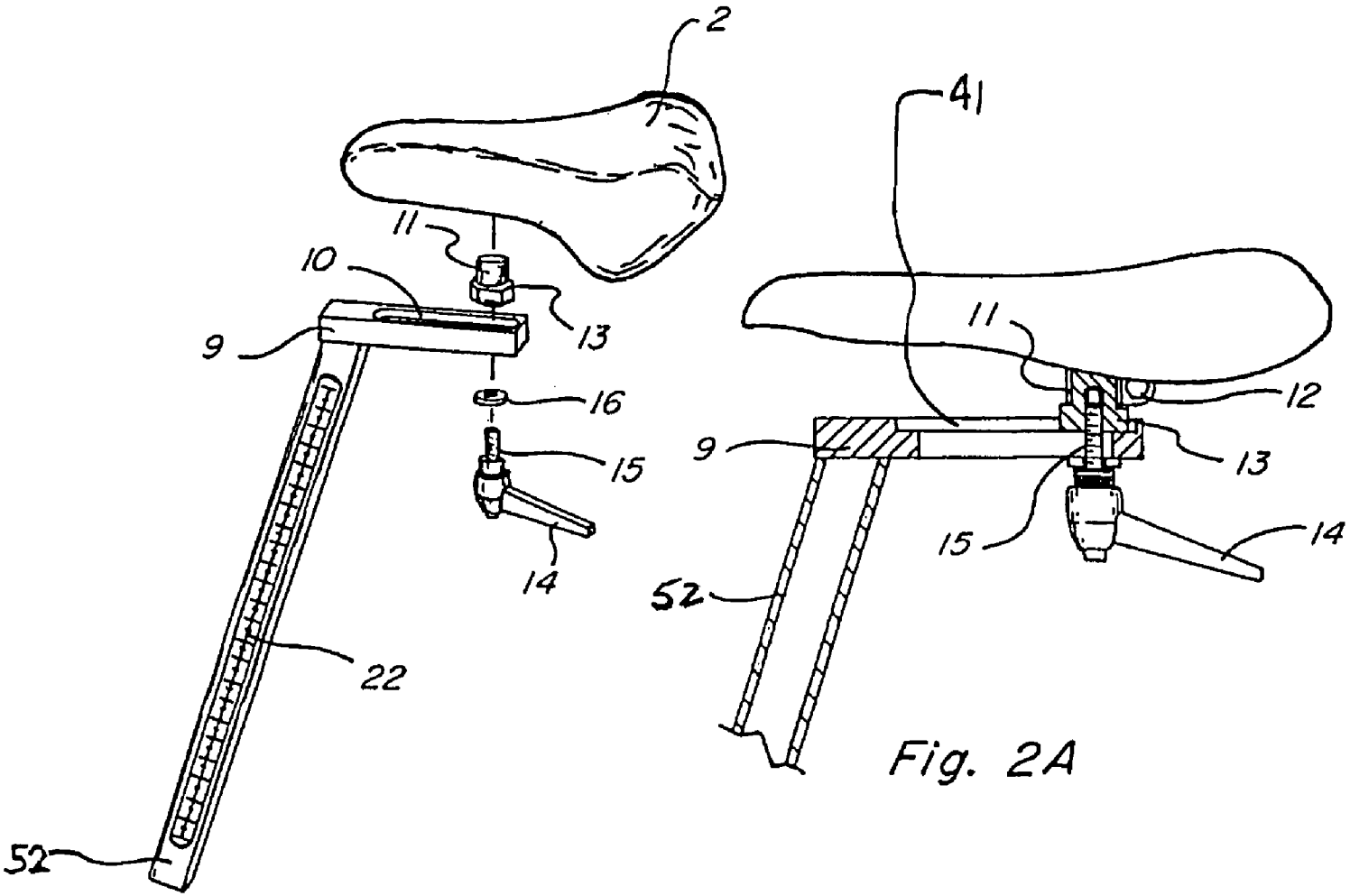
FIG. 2 is a partial side exploded view of the bicycle seat and support mechanism.
FIG. 2A is a side cutaway view of the bicycle seat and support mechanism.

Turning to FIGS. 2 and 2A, the seat and seat support mechanism are shown. The seat 2 is attached to a bicycle seat support 8. This bicycle seat support 8 is part of the frame. Slidably located inside the bicycle seat support 8 is an oblique seat support 52. The oblique seat support 52 has a horizontal seat base 9 attached at its upper end. The oblique seat support 52 has a height gauge 22 inscribed on the outer surface thereof. The horizontal seat base 9 has a longitudinal groove 10 cut into the upper portion of the seat base 9. A seat peg 11 is adapted to attach to the seat 2. This seat peg 11 has a vertical shaft, which is attached to the seat by means of the standard double bolt mechanism 12 and has a threaded female hole therein. The seat peg may have at least one flat side.

Once the seat 2 has been firmly attached to the upper part of the seat peg 11, the lower head 13 of the seat peg 11 is inserted into the horizontal seat base groove 10. This base groove 10 may have a recessed flange 41 adapted to receive the lower part 13 of the seat peg 11. The flat portion of the seat peg corresponds to a flat portion of the seat groove. Because at least one of the sides of the lower head 13 is flat, and because the groove 10 has at least one flat side, the seat is prevented from rotating. The seat peg and groove may have two flat corresponding sides as shown in drawing FIG. 2. The lower head 13 of the seat peg is slidably located within the groove 10 and may ride on the lower part of recessed flange 41. This arrangement provides for horizontal (fore and aft) adjustment of the seat position.

The seat 2 is slidably yet firmly attached to the horizontal seat base 9 by means of the seat release lever 14. The seat release lever 14 has an upper threaded shaft 15 which mates with the female shaft threads located on the inside of the seat peg 11. A washer 16 is also utilized to keep the mechanism tightened.

The seat may be adjusted horizontally either towards the handlebars or away from the handlebars by means of the quick release handle 14 across an infinite number of positions limited only by the length of groove 10. The groove defines the limits of the broad range of adjustments.

The vertical height of the seat 2 is similarly infinitely adjustable across the broad range of adjustments by use of a seat height lever 39. The seat lever 39 functions in the same manner as handlebar vertical adjusting lever 39', combining with a threaded spacer, a tightening pill having an upper pill shaft and a lower pill flange, an adjusting hole in the bicycle seat support 8, and a quick release lever having a handle and a threaded shaft, to facilitate the infinite adjustment of the seat. These elements are similar to the elements of the vertical adjusting mechanism of the handlebars, discussed below.

Figure 3:
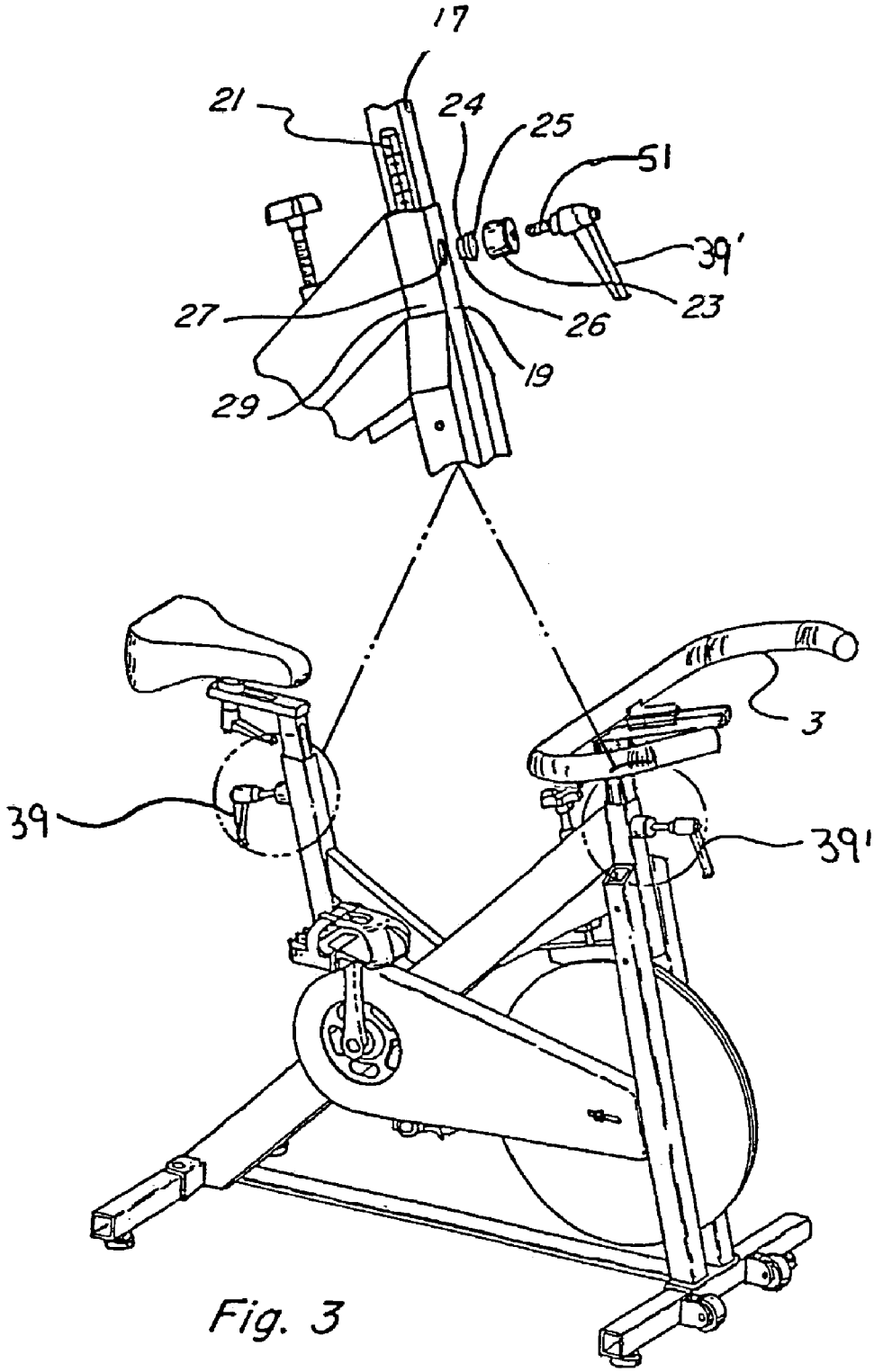
FIG. 3 is a perspective exploded view of the quick release system for the bicycle handlebars and support.

The vertical height of the handlebars may also be adjusted as illustrated in FIGS. 3 and 3A. The handlebars are attached to an oblique handlebar support 17. This handlebar support has an essentially rectangular cross section. The front surface 18 of the handlebar support 17 has a V-shaped indentation. This V-shaped indentation is best shown in FIG. 3B. The handlebar support slides into the bicycle front support 19. The bicycle front support 19 also has an essentially rectangular cross section, and is attached to the lower frame 6, as shown in FIG. 1. One outer surface 20 of the bicycle front support 19 has a corresponding protruding V-shaped surface, as shown in FIG. 3B. The protruding V-shaped surface of the front support 19 corresponds to the V-shaped indentation of the front surface of the handlebar support 17. This V-shaped protrusion and channel keep the handlebars in firm orientation with the front support 19 such that the handlebars do not sway back and forth when the user is alternating weight between the left and right handlebars.

The oblique handlebar support 17 slides inside the bicycle front support 19 such that the height of the handlebars may be infinitely adjusted across the range of adjustments defined by the length of the handlebar support 17. The height of the handlebars may be set specifically by means of the ruler scale 21, as shown on FIG. 3. Rather than using a pop pin mechanism which allows only for the seat or handlebar adjustments to be made incrementally according to the spacing of the preset holes, both the seat 2 and handlebars 3 in the present invention may be infinitely adjusted in a fore and aft position over the broad range of height and horizontal adjustments as measured by the handlebar ruler scale 21 and the seat scale 22.

As best shown in FIGS. 3 and 3A, the vertical adjustment of the handlebars may be made using a threaded quick release lever 39' similar to the quick release lever 39 used for the vertical seat adjustment. This quick release lever 39' also has a threaded shaft 51. A threaded spacer 23 is affixed to the front surface 20 of the bicycle support 19. Inside this threaded spacer 23 is located a brass pill 24. This brass pill 24 has an upper head 25 and a lower shaft 26 as shown on FIG. 3. The brass pill head 25 creates a flange, which prohibits the entire brass pill 24 from going through the adjusting hole 27. As best shown in FIG. 3A, once the oblique handlebar support 17 has been correctly positioned, the quick attach lever 39' is turned such that the shaft 51 tightens the brass pill 24 which in turn secures the handlebar support 17 in stationary position with respect to the bicycle front support 19.

Figure 8:
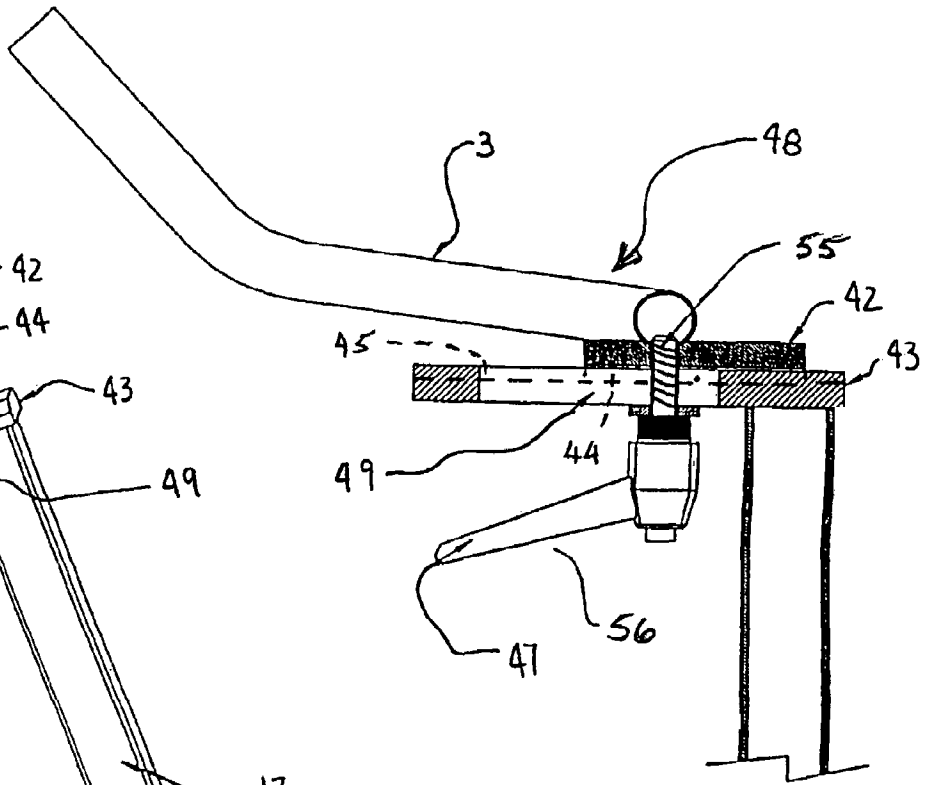
FIG. 8 is a side cutaway view of the fore/aft handlebar mechanism.
Figure 7:
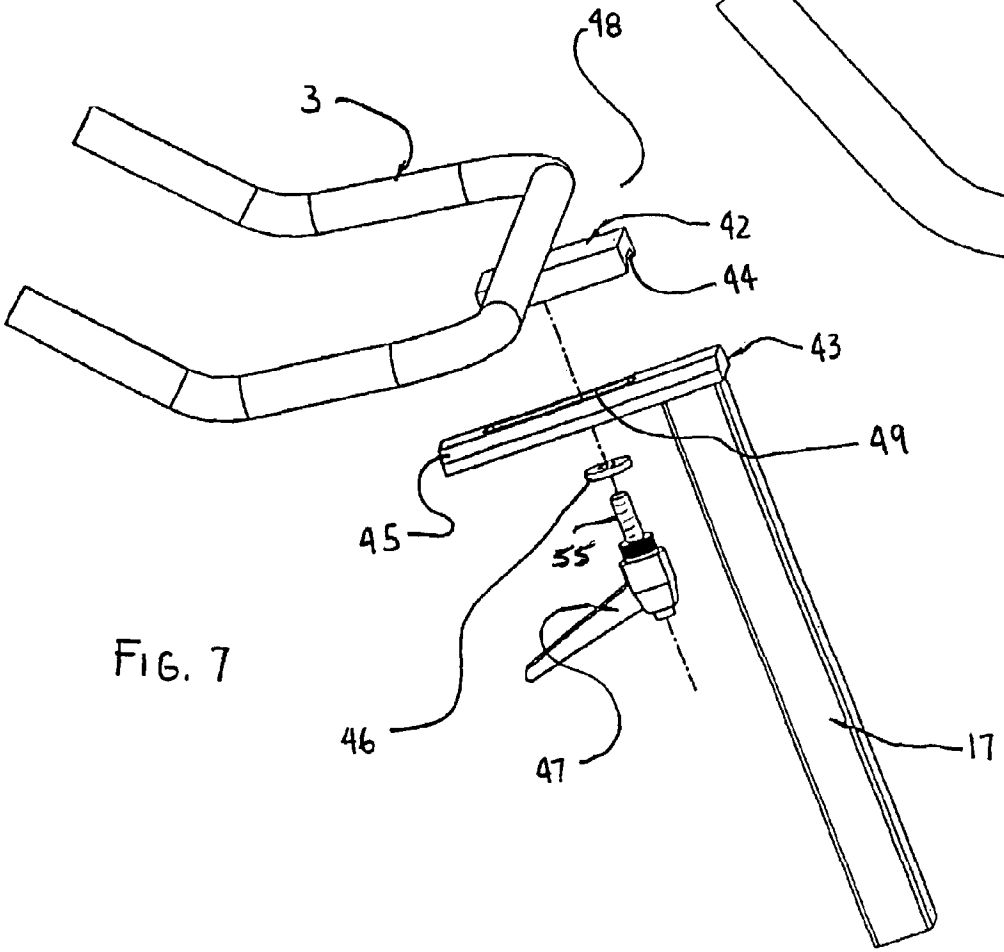
FIG. 7 is an exploded perspective view of the unique fore/aft handlebar mechanism.

Referring now to FIGS. 7 and 8, there is shown in detail the handlebar horizontal adjustment means for the fine adjustment of the horizontal position of the handle bar 3 and the handlebar support 17. The handlebar horizontal adjustment means is somewhat similar to the seat horizontal adjustment means in that it is used for releasably locking the handlebars in a finely tuned (or infinitely adjustable) horizontal relationship with respect to the seat, pedals and frame of the device.

A handlebar horizontal adjustment means, shown generally at 48, comprises a handlebar horizontal piece 42 that is affixed to handlebars 3. The handlebar horizontal piece 42 slides on top of a handlebar horizontal support 43. The handlebar horizontal support is attached to the top of the oblique handle bar support 17. The handlebar horizontal support has a handlebar horizontal adjustment groove 49 cut therein as shown. Lower parallel inner edges 44 of the handlebar horizontal piece 42 are beveled as shown. Upper parallel edges 45 of the horizontal handlebar support 43 have bevels corresponding to the lower beveled edges 44 of the handlebar piece 42. These corresponding beveled edges 44 and 45 insure that the handlebar piece 42 and the handlebar horizontal support 43 remain parallel to each other as the upper piece 42 slides on top of support 43.

The handlebar horizontal piece 42 has a threaded hole therein adapted to receive the male threaded part 51 of the quick-release handlebar horizontal adjustment lever 39'. A washer 46 is also utilized in tightening the lever handle 47 into the threaded hole of the horizontal piece 42. This horizontal handlebar adjustment means 48 allows for the infinite fore and aft adjustment of the handlebars 3 with respect to the seat 2, the pedals 4 and the frame.

Another improvement over standard exercise bicycles is best shown in FIG. 4. FIG. 4 is an expanded view of the tensioning and lubricating mechanism of this device. When one sits on the bicycle and moves the pedals 4 in a clockwise direction, the drive mechanism located underneath the drive guard 7 between the pedals 4 and the working exercise wheel 5 moves the wheel. The clockwise motion of the pedals moves the exercise wheel 5 in a clockwise direction. In order to create the desired amount of friction, thus causing the work to increase or decrease, a friction piece 28 is pressed against the outer circumference of the wheel 5. The more firmly the friction piece 28 is pressed against the wheel 5, the more friction is created and the harder it is to turn the pedals 4.

Creating this friction between the friction piece 28 and wheel 5 will often cause squeaking. In order to alleviate this squeaking noise, the top and body of the friction piece 28 has drilled through it at least one friction piece port 29. This friction port or ports 29 communicate between the top and the lower surface of the friction piece. A special Teflon lubricating oil may be inserted into the port or ports 29 to lubricate the corresponding surfaces between the friction piece 28 and the working exercise wheel 5. The preferred material for the lowest portion 51 of friction piece 28 is patent leather.

The friction between the friction piece 28 and the exercise wheel 5 is adjusted by means of a friction adjusting shaft 30. A friction adjusting shaft mechanism is fairly common throughout the stationary exercise bicycle industry. Essentially the shaft 30 is positioned in a cylinder 31 such that the friction piece 28 may be moved towards or away from the working wheel 5 by a screw-type mechanism. The cylinder 31 is affixed to the crossbar 33 of the frame.

However, as best shown in FIG. 5, a unique spring biasing mechanism found only in the instant stationary exercise bicycle allows for a quick release of the wheel or for an instant brake of the wheel. A friction-tightening nut 34 is threaded and adapted to receive the threaded shaft 30 of the friction adjustment mechanism. The nut 34 may slide up or down in the cylinder 31 but does not rotate since it has the same square perimeter shape as the lower end of the shaft. The lower end of the friction adjustment shaft 30 is also attached to the friction piece 28. The threaded shaft is contained within the cylinder 31. Turning the threaded friction adjustment shaft 30 either moves the tightening nut 24 away from or towards the working exercise wheel 5.

A special friction adjusting shaft spring 32 is located in the lower part of the friction adjusting shaft cylinder 31. A flange 40 above the spring holds the spring 32 in the lower portion of cylinder 31 as shown on FIG. 5. Tightening nut 34 compresses spring 32 and increases the friction between piece 28 and wheel 5. Loosening nut 34 decreases the friction.

When it is necessary to stop the movement of the wheel 5 immediately the handle 35 of the mechanism is simply pushed down, compressing the shaft spring 32. This pushes the friction piece 28 tightly against the wheel 5 and stops rotation of the wheel. It has been found that this type of emergency quick stop mechanism is necessary for applications involving children. Children are sometimes careless or inattentive to the motion of the exercise bicycle and a quick stop emergency mechanism such as the one described is deemed highly advisable. Alternatively, if the friction adjusting shaft handle 35 is raised, the wheel may then be disengaged from the friction piece and spin freely. Moving the handle 35 upwards disengages the friction piece 28 from the moving wheel 5 and enables a person, particularly a child or adolescent, to easily and safely alight from the exercise bicycle.

Many bicycles actually used on the road are positively attached between the pedals and the wheels by a chain. Because of this positive attachment, the pedals continue to move as long as the wheel moves. On some newer bicycles, a directional clutch system is used such that the wheels can continue to turn while the pedals are disengaged due to a directional clutch system. Such a system has been specifically adapted herein in order to allow the pedals to remain stationary while the working exercise wheel continues to rotate in the clockwise direction. This system is shown particularly in FIGS. 6, 6A and 6B.

Figure 6:
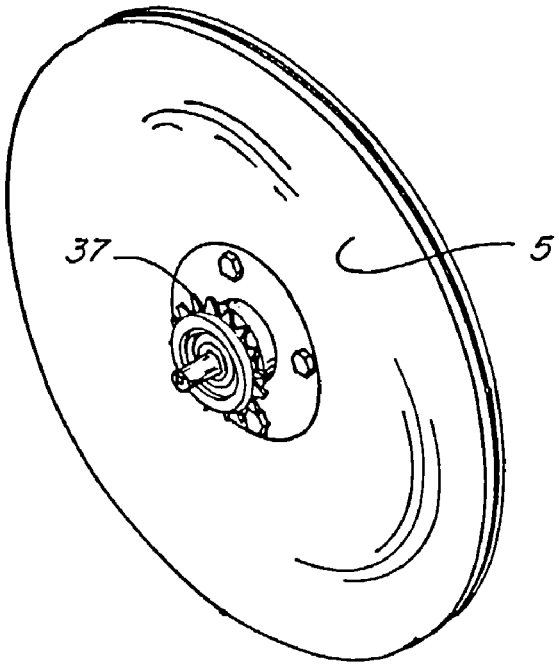
FIG. 6 is a perspective view of the working exercise wheel.

FIG. 6 is a perspective view of the working exercise wheel 5. The working exercise wheel is composed of a hub 36 and a clockwise directional clutch bearing 37. The hub, wheel, and bearing are affixed to the lower frame 6 as best shown in FIGS. and 1 and 1A.

Figure 6A:
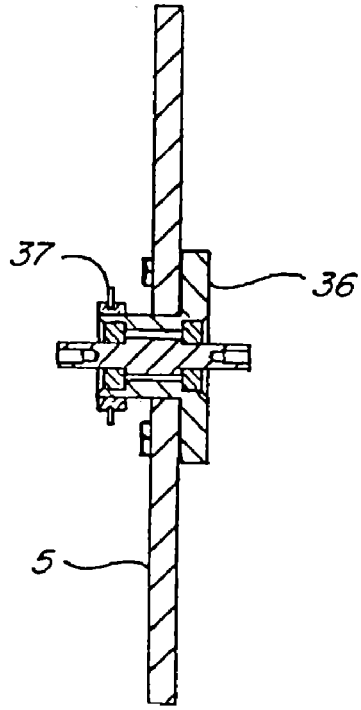
FIG. 6A is a cutaway view of the working exercise wheel taken along the diameter of the exercise wheel shown in FIG. 6.
Figure 6B:
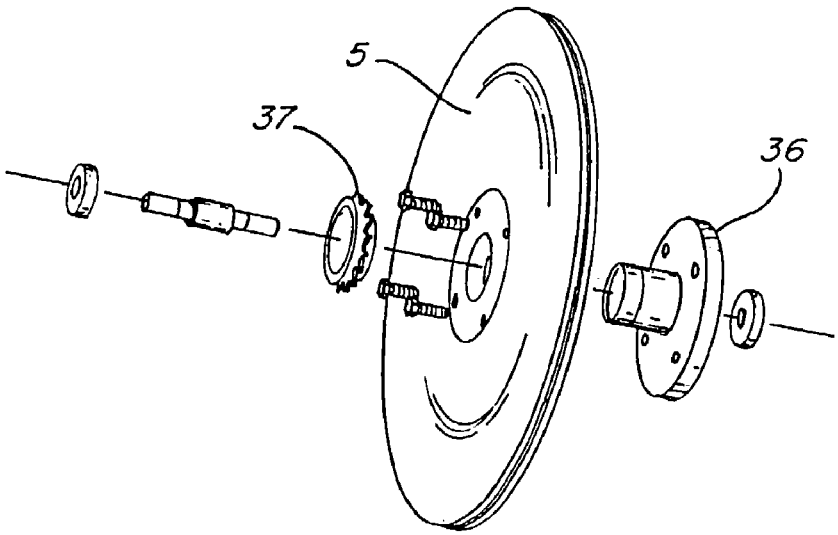
FIG. 6B is an exploded view of the working exercise wheel and hub system.

It has been found that, particularly for child or adolescent applications, the directional clutch bearing mechanism shown in FIGS. 6, 6A and 6B enhances the comfort, safety, and overall utility of the device.

A final improvement in this exercise bicycle is shown in FIG. 1. This improvement comprises a suitable cage placed around each pedal. This cage 38 keeps the child's or adolescent's foot snugly secured to the pedal 4. This pedal cage 38 allows the foot to remain in contact with the pedal even when the foot and pedals are rapidly rotating. It has been found that a safety feature such as the pedal cage 38 greatly enhances the safety and overall utility of the child and adolescent stationary exercise bicycle in particular.

While many of the aforementioned elements of the stationary exercise bicycle are common throughout the industry, the specific incorporation of the infinitely adjustable seat and handlebars, the quick release mechanisms for the adjustment of the seat and handlebars, the special lubricating elements of the device, the emergency stop and emergency release of the working wheel, as well as the clutch mechanism of the wheel and the pedal cage are all improvements over the prior art. While some of these elements have been incorporated into regular road use bicycles, incorporating these features into a stationary exercise bicycle is new and novel in the art.

Having fully described my device, I claim:

1. A braking system for a stationary exercise bicycle operable to apply rotational resistance to a wheel rotatably mounted to a bicycle frame, the braking system comprising:

a bicycle frame;

a brake pad movably attached to the frame and engageable against a rotatable wheel, that is mounted to the bicycle frame, to provide rotational resistance to the wheel, and an adjustment mechanism disposed on the frame and operable to vary contact pressure of said brake pad against said wheel, said adjustment mechanism having a force transmitting member displaceable relative to the frame, and a biasing member operatively engaged with the force transmitting member and being elastically deformable by displacing said force transmitting member against a biasing force thereof when compressed, the force transmitting member being movable toward the brake pad to apply additional contact pressure between the brake pad and the wheel, and away from the brake pad by further compressing the biasing member to thereby temporarily reduce the contact pressure between the brake pad and the wheel.

2. The braking system of claim 1, wherein said biasing member is disposed between a first reaction surface that is immobile relative to the frame and a second reaction surface disposed to transmit force from said biasing member to said force transmitting member.

3. The braking system of claim 2, wherein said second reaction surface is defined on a reaction member displaceable with said force transmitting member.

4. The braking system of clam 3, wherein said force transmitting member is a shaft and said reaction member is a nut threadably engaged thereto, said nut being held rotationally captive relative to said frame and displaceable along said shaft in response to rotation thereof within said nut, such that force exertedty said shaft against said brake pad is variable by rotating said shaft to control contact pressure of said brake pad on said wheel and therefore rotational resistance against said wheel.

5. The braking system of claim 4, wherein said first reaction surface is defined on a lower portion of a hollow tube fixed to said frame and extending there through, said shaft being received within said hollow tube.

6. The braking system of claim 4, wherein said shaft is operable to transmit force there through toward said brake pad along a longitudinal axis of said shaft in response to downward pressure applied by the user to said force transmitting member, thereby temporarily applying additional brake pad contact pressure to said wheel to at least slow rotation thereof.

7. The braking system of claim 1, wherein said biasing member provides a substantially linear resistance when subjected to elastic deformation.

8. The exercise bicycle as defined in claim 1, wherein a gap is defined between said biasing member and said force transmitting member throughout a range of elastic deformation of said biasing member.

9. A biasing mechanism for use with a braking and resistance system of an exercise bicycle, the biasing mechanism comprising a bicycle frame, a force transmitting member operatively linked to the frame and a friction pad movably attached to the frame and displaceable for adjusting contact pressure of the friction pad against a flywheel mounted to the bicycle frame, with the and a biasing member normally urging the force transmitting member toward the friction pad, the biasing member being elastically deformable away from a rest position thereof by displacing the force transmitting member away from the flywheel to reduce the contact pressure between the friction pad and the flywheel, wherein the biasing member is disposed between a first reaction surface that is immobile relative to the frame of the exercise bicycle and a second reaction surface disposed to transmit force from said biasing member to said force transmitting member.

10. The biasing mechanism as defined in claim 9, wherein said second reaction surface is defined a on force adjustment member displaceable with the force transmitting member.

11. The biasing mechanism as defined in claim 2, wherein said force transmitting member is a shaft and said force adjustment member is a nut threadably engaged thereto between the friction pad and the first reaction surface.

12. The biasing mechanism as defined in claim 11, wherein said biasing member is a compression spring disposed about, the shaft between the first reaction surface and the nut.

13. The biasing mechanism as defined in claim 9, wherein said biasing member provides a substantially linear resistance when subjected to elastic deformation.

14. The biasing mechanism as defined in claim 9, wherein a gap is defined between said biasing member and said force transmitting member throughout a range of elastic deformation of said biasing member.

15. A tensioning mechanism for use with a friction brake and a rotatably mounted flywheel of an exercise bicycle, the tensioning mechanism comprising:

a bicycle frame;

a friction brake movably attached to the frame and engageable against a flywheel, that is mounted to the bicycle frame, to provide rotational resistance to the flywheel;

a movable rod acting on the friction brake;

a member attached to the rod permitting adjustment of the rod relative to the frame and thereby adjustment of a force between the flywheel and the friction brake by the positioning of said rod; and a biasing member positioned between the frame and the member thus urging the rod towards friction brake, the biasing member being elastically deformable away from a rest position thereof to permit the rod to be pulled and thereby temporarily moved away from the flywheel such that contact pressure between the friction brake and the flywheel is at least reduced.

16. The tensioning mechanism as defined in claim 15, wherein the member is disposed on a lower end of the rod near the friction brake and the biasing member is provided on the rod above the member.

17. The tensioning mechanism as defined in claim 16, wherein the member is a nut threadably engaged to rod.

18. The tensioning mechanism as defined in claim 15, wherein the biasing member comprises a spring.

19. The tensioning mechanism as defined in claim 15, wherein a gap is defined between the biasing member and the rod throughout a range of elastic deformation of the biasing member.

20. A tensioning mechanism for use with a braking force applying friction pad and a flywheel of an exercise bicycle, the tensioning mechanism comprising:

a bicycle frame;

a friction pad movably attached to the frame and engageable against a flywheel, that is mounted to the bicycle frame, to provide rotational resistance to the flywheel;

a rod, operatively disposed on the frame, having a knob at a top end of the rod;

a member located on the rod permitting adjustment of a braking force between the flywheel and the friction pad by relative movement between the rod and the member; and a resilient element through which the rod passes and which is positioned above the member to permit the force to be applied onto the flywheel and to permit the knob and the rod to be pulled upwardly to further compress the resilient element and thereby release at least a portion of the force on the flywheel.

21. The tensioning mechanism as in claim 20 wherein said rod is threaded and said member comprises a nut threaded thereon.

22. The tensioning mechanism as in claim 21 wherein the resilient element comprises an elastic member.

23. The tensioning member as in claim 22 wherein the elastic member comprises a spring.

24. A tensioning mechanism for use with a friction pad and a flywheel of an exercise bicycle, the tensioning mechanism comprising:

a bicycle frame;

a friction pad movably attached to the frame and engageable against a flywheel, that is mounted to the bicycle frame, to provide rotational resistance to the flywheel;

an adjustment device comprising a rod operatively disposed on the frame;

a member threadedly engaged on the rod permitting adjustment of a braking force between the flywheel and the friction pad by the positioning of said rod by positioning said rod; and a resilient element provided above the member about the rod so as to engage and permit the rod to be moved upwardly to release part of the force on the friction pad.

* * * * *